US012628910B1

(12) United States Patent
Bailey

(10) Patent No.: US 12,628,910 B1
(45) Date of Patent: May 19, 2026

(54) MODULAR HEEL SYSTEM

(71) Applicant: Maurice Bailey, Hoschton, GA (US)

(72) Inventor: Maurice Bailey, Hoschton, GA (US)

( * ) Notice: Subject to any disclaimer, the term of this patent is extended or adjusted under 35 U.S.C. 154(b) by 0 days.

(21) Appl. No.: 19/296,500

(22) Filed: Aug. 11, 2025

(51) Int. Cl.

| | |
|---|---|
| ***A43B 21/42*** | (2006.01) |
| ***A43B 3/24*** | (2006.01) |
| ***A43B 21/02*** | (2006.01) |
| ***A43B 21/24*** | (2006.01) |
| ***A43B 21/52*** | (2006.01) |

(52) U.S. Cl.
CPC ..... *A43B 21/24* (2013.01); *A43B 3/24* (2013.01); *A43B 21/025* (2013.01); *A43B 21/42* (2013.01); *A43B 21/52* (2013.01)

(58) Field of Classification Search
CPC ..... A43B 21/24; A43B 21/42; A43B 21/52; A43B 3/24; A43B 3/246
USPC ..... 36/42, 41, 36 R
See application file for complete search history.

(56) References Cited

U.S. PATENT DOCUMENTS

| | | | | |
|---|---|---|---|---|
| 1,344,356 | A * | 6/1920 | Sahr | A43B 13/34 36/40 |
| 2,417,906 | A * | 3/1947 | Boivin | A43B 13/34 36/42 |
| 2,852,866 | A * | 9/1958 | Quirk | A43B 21/46 36/42 |
| 3,041,746 | A * | 7/1962 | Rakus | A43B 21/46 36/36 R |
| 3,664,041 | A * | 5/1972 | Frattallone | A43B 21/46 36/34 B |
| 4,272,897 | A * | 6/1981 | Ponce | A43B 23/22 36/76 R |
| 6,023,858 | A * | 2/2000 | Srourian | A43B 21/42 36/11.5 |
| 8,132,341 | B1 | 3/2012 | Laramore | |
| 9,693,598 | B1 | 7/2017 | Rose | |
| 10,064,450 | B1 | 9/2018 | Groves-Hill | |
| 10,531,706 | B2 * | 1/2020 | Alander | A43B 21/47 |
| 11,311,077 | B2 | 4/2022 | Pavone et al. | |
| 11,337,489 | B2 | 5/2022 | Lewis | |
| 2002/0133980 | A1 * | 9/2002 | Pan | A43B 21/24 36/100 |
| 2002/0144436 | A1 * | 10/2002 | Magallanes | A43B 21/52 36/100 |
| 2006/0196082 | A1 | 9/2006 | Robbins | |

(Continued)

FOREIGN PATENT DOCUMENTS

| | | | |
|---|---|---|---|
| DE | 202014011128 | U1 | 1/2018 |
| EP | 3949782 | A1 | 2/2022 |

(Continued)

*Primary Examiner* — Marie D Bays

(57) ABSTRACT

In some implementations, a modular heel system may include a heel having a heel body and a shaft. The heel body may be configured for attachment to a sole of a shoe. The shaft may extend from the heel body and may have at least one flat side along its longitudinal axis for retention of interchangeable modular elements. The modular elements may be configured to be detachably affixed to the heel, each modular element having a through-hole having a geometry which is complementary to the longitudinal geometry of the shaft. The modular heel system may include a retention element configured to secure the modular elements when attached to the heel and to serve as a durable base which is in contact with the ground during use.

20 Claims, 13 Drawing Sheets

(56) References Cited

U.S. PATENT DOCUMENTS

| | | | | |
|---|---|---|---|---|
| 2008/0263898 | A1* | 10/2008 | Gueh | A43B 21/52 36/23 |
| 2012/0117830 | A1* | 5/2012 | Chen | A43B 21/24 36/34 R |
| 2012/0186105 | A1* | 7/2012 | Kemp | A43B 21/48 36/100 |
| 2014/0096413 | A1* | 4/2014 | Anderson | A43B 21/42 36/100 |
| 2016/0235163 | A1* | 8/2016 | Alander | A43B 21/433 |
| 2016/0331080 | A1 | 11/2016 | Weaver | |
| 2017/0245583 | A1 | 8/2017 | Mcnamara-Schwartz | |
| 2018/0368522 | A1* | 12/2018 | Roth | A43B 21/24 |
| 2020/0268103 | A1 | 8/2020 | Levy et al. | |
| 2021/0145113 | A1 | 5/2021 | Zuborev et al. | |
| 2023/0137872 | A1 | 5/2023 | Gallegos | |
| 2025/0082066 | A1* | 3/2025 | Chong | A43B 21/42 |

FOREIGN PATENT DOCUMENTS

| | | | |
|---|---|---|---|
| FR | 3086144 | A1 | 3/2020 |
| WO | WO 9911204 | A1 | 3/1999 |
| WO | WO 2022158959 | A1 | 7/2022 |

* cited by examiner

MODULAR HEEL SYSTEM

TECHNICAL FIELD

The present invention relates to modular high-heel designs, specifically a customizable attachment system that integrates a load-bearing heel with interchangeable modular elements.

BACKGROUND

Traditional modular heels offer interchangeability, but often lack structural reinforcement, resulting in limited durability and customization. Existing designs primarily rely on snap-on or spring-lock mechanisms, which can compromise stability under load-bearing conditions due to the presence of multiple connection points.

Current designs also fail to incorporate mechanisms for securing interchangeable elements in a fixed position during use without sacrificing ease of assembly. For example, existing systems incorporate edges, grooves, or other features which require heightened precision and effort from a user in aligning corresponding modular components.

Current heel designs also fail to offer a simplistic retention mechanism which allows design flexibility in manufacturing modular components without sacrificing stability or durability during use.

SUMMARY

In one general aspect, a modular heel system may include a heel having: a heel body configured to be attached to a sole of a shoe; a shaft extending from the heel body, the shaft having at least one flat side along its longitudinal axis; one or more modular elements configured to be detachably affixed to the heel, each modular element having a through-hole having a geometry which is complementary to a longitudinal geometry of the shaft; and a retention element configured to secure the modular elements when attached to the heel.

In another aspect, a modular heel system may include a heel which has a unitary structure.

In yet another aspect, the heel may include a metal material or a polymer material.

In yet another aspect, one or more modular elements may be composed of a metal, polymer, or other material.

In yet another aspect, the shaft of the heel and the through-hole of a modular element have similar or congruent form. For example, the shaft of the heel and the through-hole of a modular element may each have an obround form.

In yet another aspect, the shaft of the heel and the one or more modular elements are dimensioned to achieve frictional engagement in order to prevent vertical and rotational displacement. For example, the shaft of the heel and the through-hole of a modular element have a size and shape which achieves one of: a clearance fit, a transition fit, and an interference fit in order to prevent vertical and rotational displacement.

In yet another aspect, one or more modular elements each may include a body which has a fixed orientation relative to its vertical axis.

In yet another aspect, one or more modular elements may include a body having an exterior form of an alphanumeric character or symbol.

In yet another aspect, one or more pairs of modular elements are configured to be affixed to the heel rod in a horizontal arrangement. For instance, each pair of modular elements may include one or more sets of complementary fastening members configured to secure the modular elements to one another in a horizontal arrangement.

In yet another aspect, a first modular element of a pair of modular elements has a first engagement channel; a second modular element of the pair of modular elements has a second engagement channel; and when the first modular element and the second modular element are secured to one another, the first engagement channel and the second engagement channel mate to form a through-hole through which the shaft may be inserted.

In yet another aspect, a modular heel system may include one or more spacer elements configured to provide an expanded contact surface for interfacing with one or more adjacent modular elements.

DETAILED DESCRIPTION

For the purposes of description herein, the term "front" is used herein to refer to a direction which is parallel to the ground and towards the toe end of a shoe, and the terms "back" and "rear" are used herein to refer to a direction which is parallel to the ground and towards the heel or ankle portion of a shoe, unless explicitly stated otherwise or ruled out by context. Similarly, the term "upper" or "top" are used herein to refer to a direction which is perpendicularly away from the ground while the terms "lower" or "bottom" are used herein to refer to a direction which is perpendicularly towards the ground, unless explicitly stated otherwise or ruled out by context. Taking FIG. 1B as an example, a "front" portion of a component will appear towards the left side of the page relative to a "back" or "rear" portion of the component, and an "upper" or "top" portion of a component will appear towards the top of the page relative to a "lower" or "bottom" portion of the component.

Figure 1A:
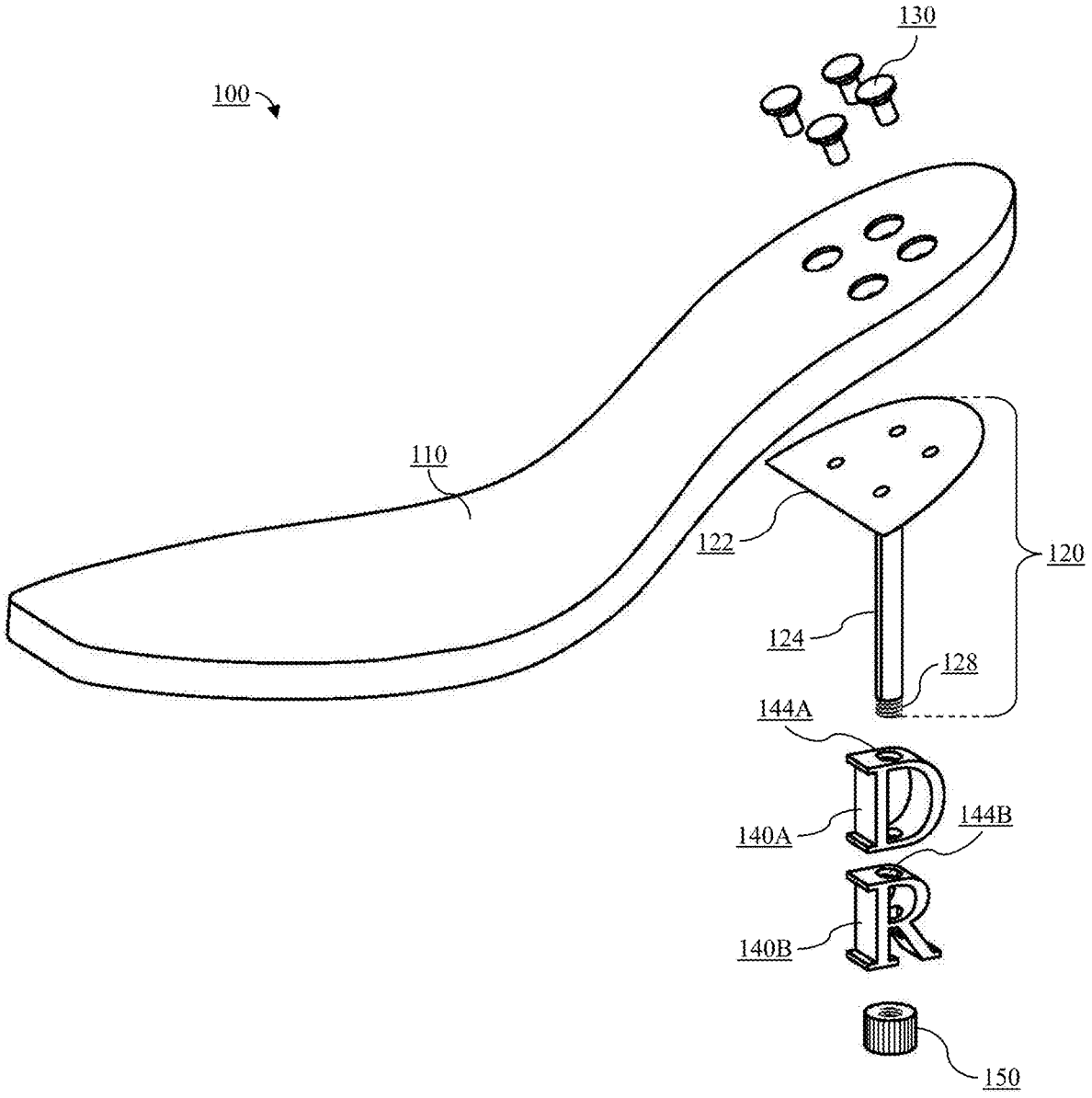
FIGS. 1A-1C depict an exemplary embodiment of a modular heel system in accordance with the present disclosure.
Figure 1B:
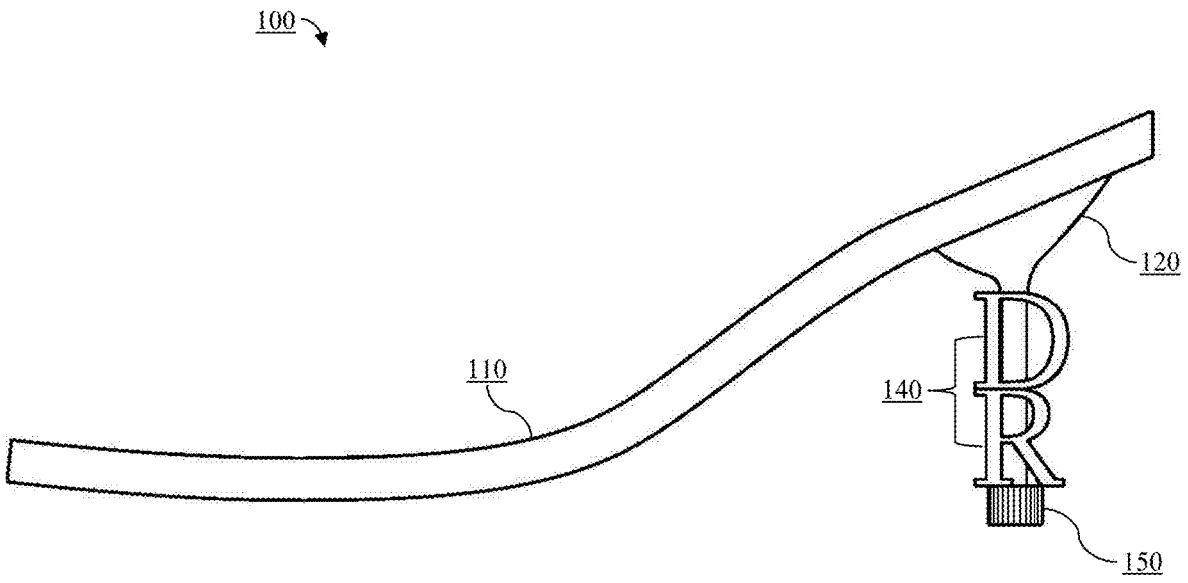
Figure 1C:
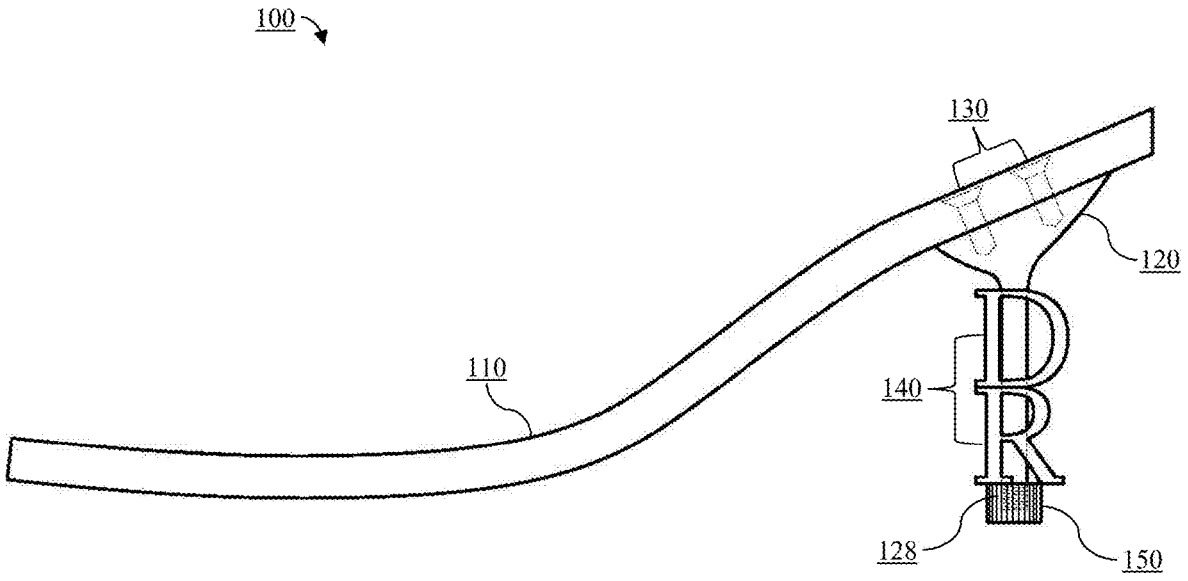
Figure 2A:
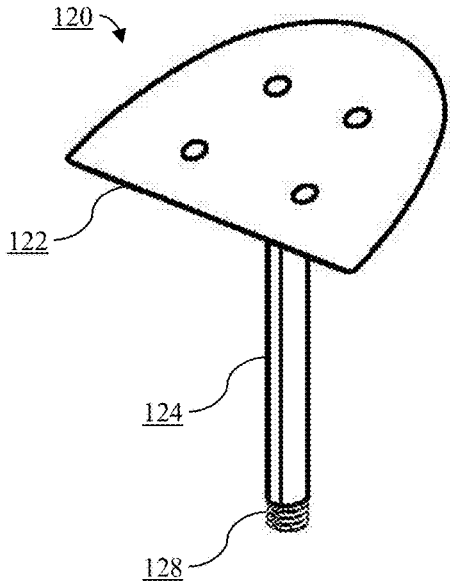
FIGS. 2A-2D depict an exemplary embodiment of a heel in accordance with the modular heel system of the present disclosure.
Figure 2B:
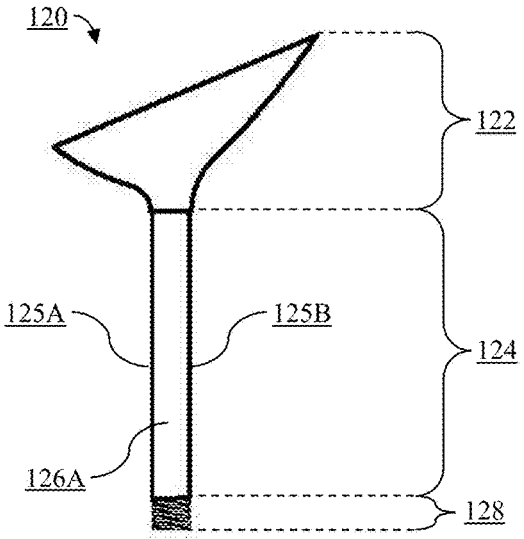
Figure 2C:
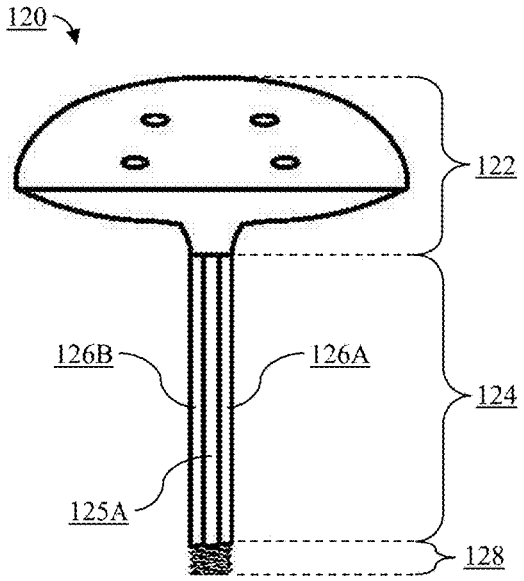
Figure 2D:
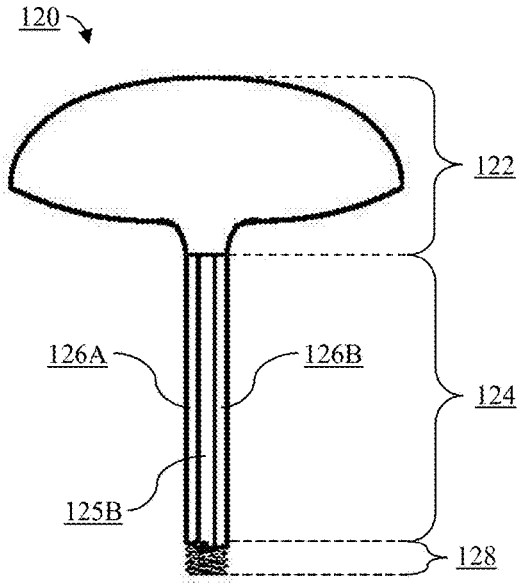
Figure 3A:
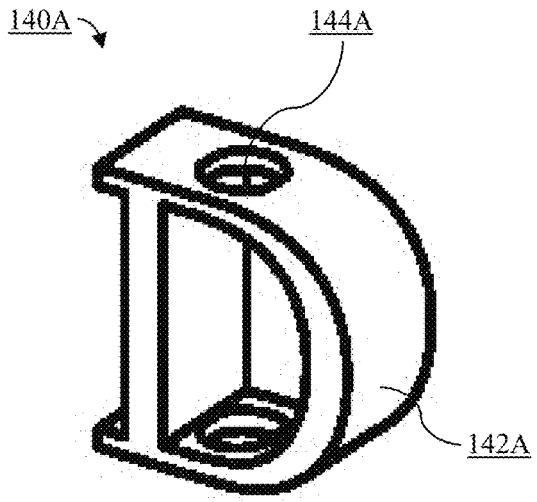
FIGS. 3A-3D depict an exemplary embodiment of a modular element in accordance with the modular heel system of the present disclosure.
Figure 3B:
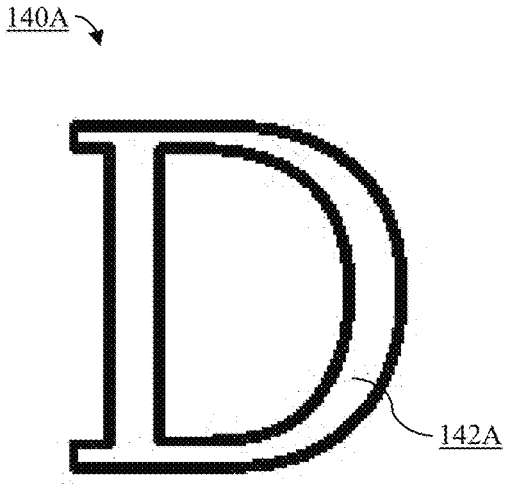
Figure 3C:
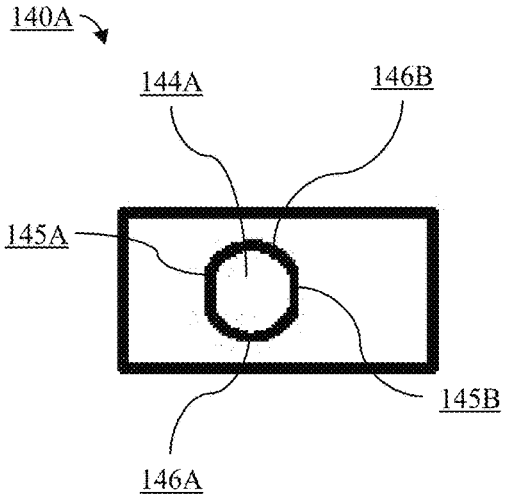
Figure 3D:
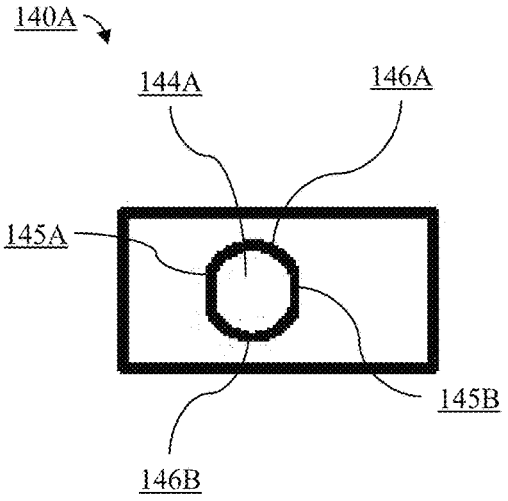
Figure 4A:
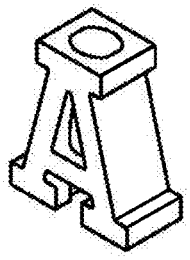
FIGS. 4A-4I depict other exemplary embodiments of a modular element in accordance with the modular heel system of the present disclosure.
Figure 4B:
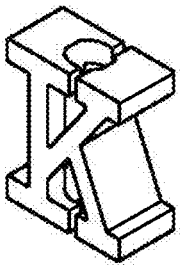
Figure 4C:
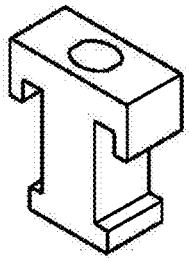
Figure 4D:
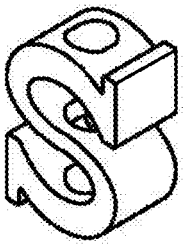
Figure 4E:
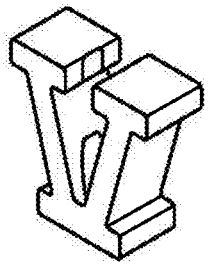
Figure 4F:
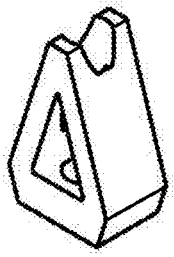
Figure 4G:
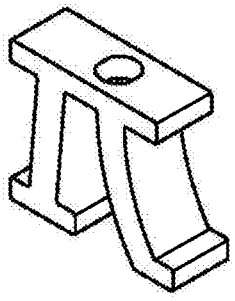
Figure 4H:
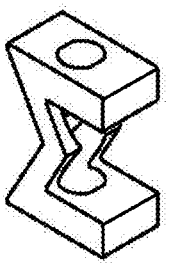
Figure 4I:
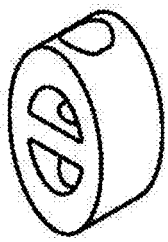
Figure 5A:
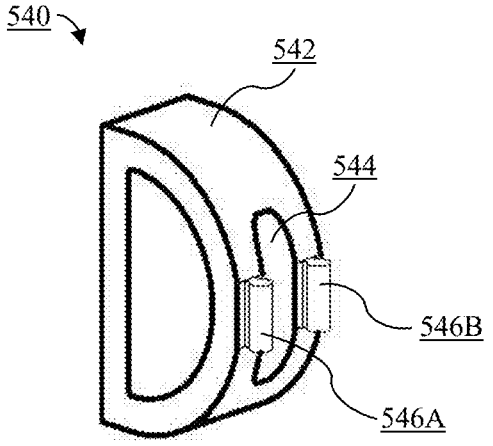
FIGS. 5-8 depict an example of a modular heel system including modular elements arranged in a horizontal arrangement, in accordance with some embodiments.
Figure 5B:
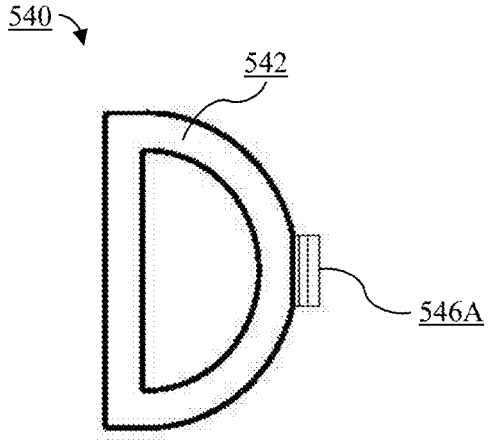
Figure 5C:
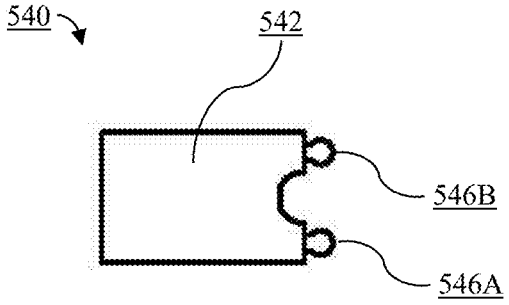
Figure 5D:
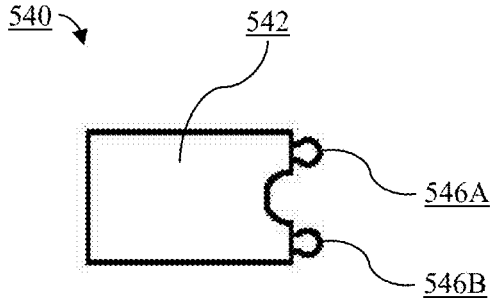
Figure 5E:
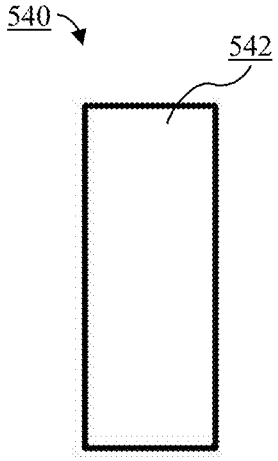
Figure 5F:
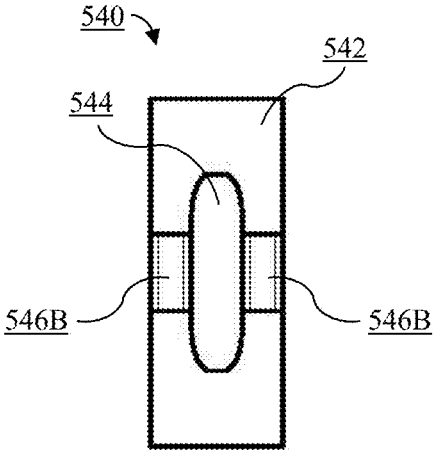
Figure 6A:
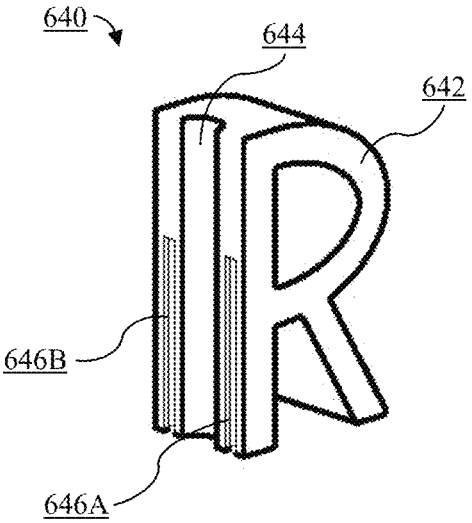
Figure 6B:
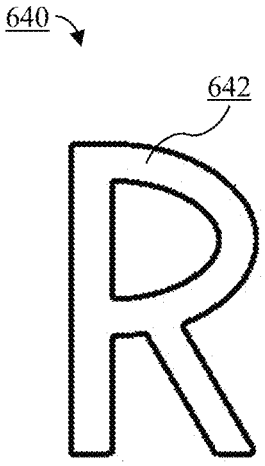
Figure 6C:
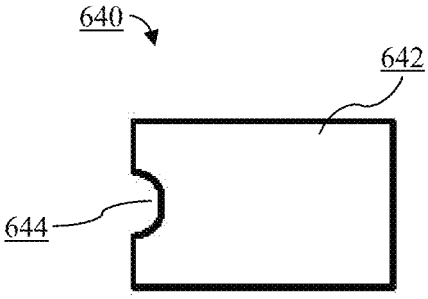
Figure 6D:
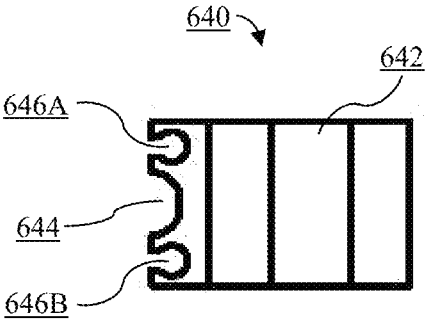
Figure 6E:
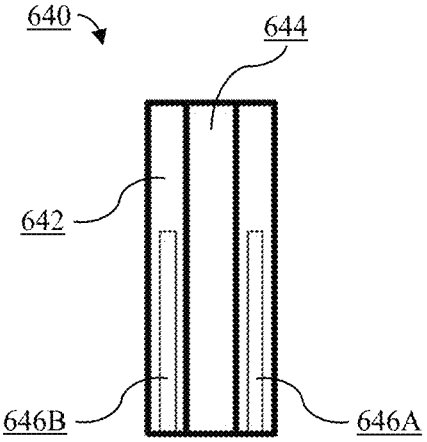
Figure 6F:
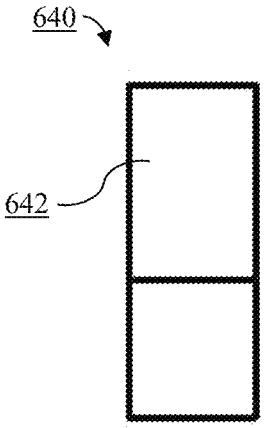
Figure 7A:
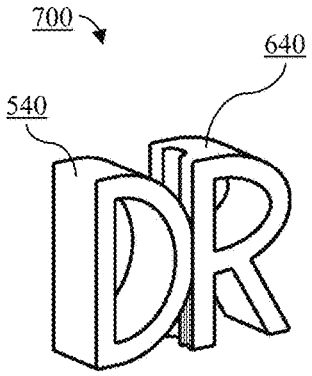
Figure 7B:
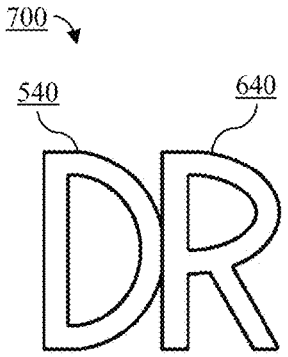
Figure 7C:
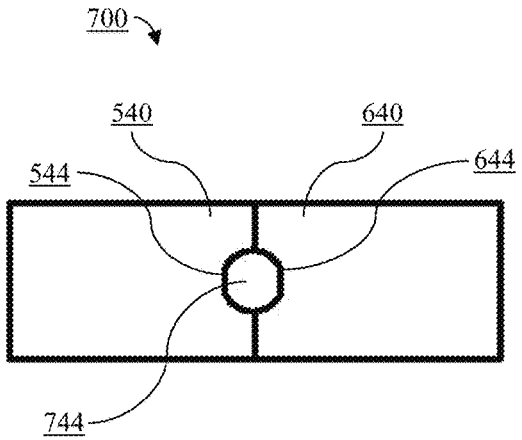
Figure 7D:
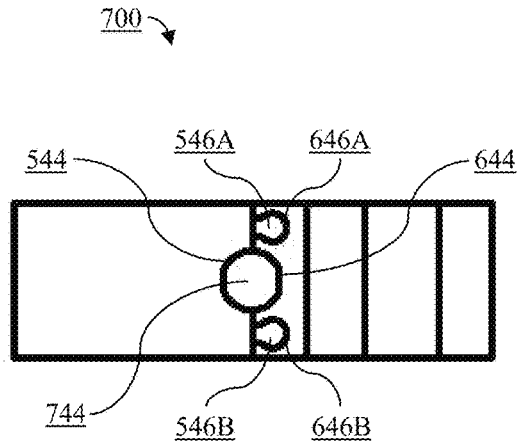

FIGS. 1A-1C depict an example of a modular heel system in accordance with the present disclosure. FIG. 1A depicts an exploded view of the components of the modular heel system 100. FIGS. 1B and 1C depict the modular heel system 100 when assembled, with FIG. 1C depicting certain components which are hidden from view when assembled.

Modular heel system 100 may include a sole 110, a heel 120 configured to be attached to the sole 110, one or more fastening elements 130 configured to secure heel 120 to sole 110, one or more modular elements 140 configured for engagement with the heel 120, and a retention cap 150 configured to secure the one or more modular elements 140 on heel 120.

As is known in the art, the sole may include one or more components or component layers such as insole, outsole, heel seat, padding or support material, or the like. Components of the sole are typically made from materials such as rubber, foam, leather, wood, metal, polymer, composite, or the like. In some embodiments, the sole may include one or more components of the heel rod system. One or more components of the heel rod system may be structurally incorporated into (e.g., fixedly attached to or encased within) the sole, as further discussed herein. In some embodiments, one or more components of the sole may be structurally incorporated into the heel rod system, as further discussed herein.

As depicted, sole 110 may include one or more openings at the rear portion which allow pass-through of one or more fastening elements 130 for affixing sole 110 to a heel 120. In some embodiments, one or more mounting elements may be integrated into the sole 110 for engagement with a corresponding one or more mounting elements of the heel 120, either in addition to or in place of the one or more fastener openings.

A shoe which includes the modular heel system of the present disclosure may further include an upper (not shown) which is connected to the sole 110. As understood in the art, the upper is the part of the shoe which engages one or more portions of the top of a user's foot and holds it in place against the sole. The upper may include various components such as a toe box, a vamp, a counter, a lining, a tongue, a shaft, a collar, or the like. The upper may be designed in any suitable manner as would be appreciated by those of ordinary skill without departing from the scope of this disclosure.

Heel 120 serves as the primary load-bearing component of the modular heel system 100. Heel 120 may include a heel body 122 configured for attachment to a sole of a shoe and a shaft 124 configured to engage one or more modular elements.

Heel body 122 is configured for attachment to a sole of a shoe, such as sole 110. In some embodiments, heel body 122 may be configured to be fixedly engaged with sole 110. For example, as depicted, heel body 122 may include one or more cavities each configured to receive a corresponding fastener 130. One or more fasteners 130 may include a rivet, a threaded bolt, or a screw. Each fastener 130 may be passed through a corresponding opening in the sole 110 and into a corresponding cavity of the heel body 122 in order to secure the heel 120 to the sole 110, as depicted in FIG. 1C. The depicted example shows a heel body 122 including four cavities arranged along its upper surface for receiving a corresponding four fasteners 130. Where a threaded bolt is used, a corresponding cavity may be designed to include a complementary threaded surface for receiving the bolt and securing it in place. Similarly, the cavities may be designed to include threading which is complementary to that of a corresponding screw. A fixed engagement, such as that resulting from the use of rivets, bolts, or screws, helps to ensure that the heel 120 remains securely attached to the sole 110 during use.

The upper surface of heel body 122 may be substantially flat such that it sits flush against sole 110 when engaged. In this manner, weight from a user's heel may be evenly distributed across an expanded contact zone, thus minimizing stress concentration at a specific location of the user's foot. In some embodiments, heel body 122 may include an upper surface which spans a portion or the entirety of a rear portion of the sole 110. In some embodiments, heel body 122 may be designed to wrap around the edges of sole 110 for enhanced weight distribution support. In some embodiments, an adhesive may be applied to further secure the upper surface of heel body 122 to the sole 110. The upper surface of heel body 122 may be configured at a suitable angle such that shaft 124 rests perpendicular to the ground when assembled. The angle of the upper surface may vary depending on the desired height of heel 120 and the configuration of sole 110. For example, the upper surface of heel body 122 of a three-inch heel 120 may have an angle of about 21-24 degrees relative to the ground, while that of a five-inch heel 120 may have an angle of about 26-29 degrees relative to the ground.

The overall shape and dimensions of heel body 122 may vary depending on design requirements. In some embodiments, the shape and dimensions of heel body 122 may be designed to mimic that of traditional heels, such as cone heels or block heels. For example, as depicted in FIGS. 1A-1C and 2A-2D, heel body 122 may be configured in the form of a cone heel, thus maintaining the aesthetics of traditional high heels while providing the advantages discussed herein.

In some embodiments, heel body 122 may be configured to be detachably engaged with sole 110 in order to enable users to swap one heel rod for another. For example, heel body 122 and/or sole 110 may incorporate snap-fit, clip-in, bayonet mount, or other form detachable engagement. Heel body 122 may incorporate a mounting means configured to mate with a complementary mounting means incorporated into sole 110 (e.g., in place of the fastener-receiving cavities). In some embodiments, mounting plates may be affixed to heel body 122 and/or sole 110. In snap-fit or clip-in configurations, a first mounting plate may have integrated tabs or latches which engage with complementary mating recesses in the other. In bayonet mount configurations, a first mounting plate may include a grooved or tabbed protrusion which engages with a complementary slot in the other mounting plate in a twist-lock arrangement. In some embodiments, heel body 122 may be molded, cut, or otherwise manufactured to include embedded mounting elements on or near its upper surface which are configured to mate with corresponding mounting elements integrated into sole 110.

Shaft 124 extends from a bottom portion of heel body 122 and serves as the primary axial load-bearing member of heel 120. The bottom portion of shaft 124 may be formed as, or otherwise incorporate, a locking member 128 configured to engage with a corresponding retention cap 150, as further discussed herein. Shaft 124 is configured to be positioned in line with a user's leg and perpendicular to the ground when heel 120 is attached to a sole 110. Shaft 124 may vary in length and cross-sectional dimensions based on desired heel height, user weight capacity, and selected materials. Longer shafts may utilize larger diameters to resist buckling and bending, while shorter shafts may accommodate slimmer dimensions while maintaining structural integrity. Such design considerations follow standard column stability principles, balancing moment of inertia with material strength. In some embodiments, shaft 124 has a maximal diameter between approximately 4 mm and 7 mm.

Shaft 124 is configured to engage one or more modular elements, such as modular elements 140A and 140B. Shaft 124 has a longitudinal geometry which prevents rotational displacement of modular elements 140 when engaged. In particular, shaft 124 may be configured with at least one flat side along its longitudinal axis. Respectively, each modular element 140 includes a through-hole, such as through-holes 144A and 144B, having a flat-sided geometry which is complementary to the longitudinal geometry of the shaft. A modular element 140 may be engaged with the heel 120 by passing the shaft 124 through its through-hole 144. When shaft 124 is engaged with one or more modular elements 140 having a complementary through-hole 144, the edges created by one or more flat sides ensure that the modular elements cannot rotate while attached to the shaft. Once engaged, rotational displacement of modular elements 140 is prevented due edge interactions between the flat-sided shaft 124 and the flat-sided through-hole 144.

Shaft 124 and through-holes 144 may be configured to have a cross section having any suitable flat-sided shape, such as square, rectangle, triangle, pentagon, hexagon, or the like, in order to rotationally retain the one or more modular elements 140.

Preferably, shaft 124 and through-holes 144 further include at least one rounded or curved side in addition to the at least one flat side. The inclusion of a rounded side reduces insertion resistance created by flat-sided edges and makes it easier for a user to slide modular elements 140 onto and off of shaft 124.

Referring to FIGS. 2A-2D, an axonometric view, a side view, a front view, and a rear view, respectively, of the heel 120 are shown. In the preferred embodiments, shaft 124 has an obround exterior shape along its longitudinal axis. An obround shape has the form of a flattened circle, with two parallel flat sides and two opposing round sides. For example, shaft 124 may have two parallel flat sides 125A and 125B and two opposing semicircular sides 126A and 126B. This configuration provides a number of advantages compared to other possible shapes. First, the edges present between each pair of flat and round sides mechanically prevent rotational displacement of the modular elements 140 when engaged with shaft 124, which is critical for maintaining a desired orientation of the modular elements 140 during use. Further, the presence of round sides, such as semicircular sides 126A and 126B, allows a user to easily slide modular elements 140 onto and off of the shaft 124 compared to a completely flat-sided configuration, such as square or rectangular, which is sensitive to alignment errors and has the potential to introduce undue stress or wear along the edges. Further, the combination of a pair of flat sides with a pair of round sides creates a limited set of predefined orientations for alignment of modular elements, which limits the effort required from a user in properly aligning modular elements which have a specific desired appearance relative to the shoe (e.g., letters or symbols which may need to be displayed facing a particular direction).

In another embodiment, the shaft 124 may have exactly one flat side and exactly one round side, creating a semicircular or half-moon shape along its longitudinal axis. It should be understood that other combinations of flat and/or round sides of the shaft 124 may be possible without departing from the scope of this disclosure.

Returning to FIGS. 1A-1C, shaft 124 and through-holes 144 are thus configured to be complementary to one another to allow a user to slide modular elements 140 onto and off of shaft 124. In some embodiments, the exterior surface of shaft 124 and through-hole(s) 144 are configured to be congruent or similar to one another. As used herein for the purposes of describing component geometries, the term "similar" refers to the characteristic of having the same shape but different size. For similar geometries, the size difference between the cross sections of shaft 124 and through-hole(s) 144 should be sufficiently small to ensure rotational locking at the flat-side edges.

In some embodiments, shaft 124 and/or through-holes 144 may further be configured to axially retain the one or more modular elements 140 when engaged. While a shaft 124 and corresponding through-hole(s) 144 may be dimensioned to allow respective modular elements 140 to slide along the shaft, they may also be configured to produce frictional engagement between the shaft and the modular elements. In order to achieve this, certain types of clearance fit or transitional fit may be implemented to allow a modular element to slide along the shaft under a minimal amount of manual force while retaining itself on the shaft against the force of gravity through friction. The particular type of fit chosen to produce a frictional engagement, and the associated dimensions of the shaft and the through-holes, may vary depending on the materials used and the desired amount of frictional resistance. As a nonlimiting example, friction fit may be achieved between a modular element 140 composed of a polymer, such as ABS, having a through-hole diameter which is up to about 20 mm larger than the diameter of a shaft 124 composed of a metal, such as stainless steel. In some embodiments, an interference fit may be appropriate for detachably securing modular elements onto the heel. For example, if a soft or elastic material forms the exterior surface of a modular element, such as rubber or fabric, the through-hole may be dimensioned to be slightly smaller than the diameter of the shaft in order to achieve axial retention through compression fit.

Referring to FIGS. 3A-3D, an axonometric view, a side view, a top view, a bottom view, a front view, and a rear view, respectively, of the exemplary modular element 140A are shown. Modular element 140A includes a body 142A and a through-hole 144A. Body 142A may have any desired shape or form. For example, body 142A may take the form of an alphanumeric character, such as a letter of an alphabet. In the depicted examples, modular element 140A has a body 142A in the form of a block letter "D." Body 142A may be composed of any suitable material including, but not limited to, one or more of: polymers (e.g., ABS, polycarbonate, nylon, polypropylene, acrylic, polyurethane), metals (e.g., aluminum, stainless steel, brass, bronze, titanium), composites (e.g., carbon fiber reinforced polymer, metal-plated plastic, wood-plastic composite), wood, resin, epoxy, fabric, leather, rubber, or a combination thereof.

A linear through-hole is configured to pass through one or more portions of a body of a modular element. For example, through-hole 144A follows a straight line passing through a top portion and a bottom portion of the body 142A of modular element 140A. The position of the through-hole along the body corresponds to a desired orientation of the modular element when engaged with a heel. In particular, the through-hole forms a vertical axis which is to be aligned with the shaft of a heel, thus defining the orientation of the respective modular element relative to the heel. In the depicted example, through-hole 144A is placed through body 142A such that the letter "D" may appear horizontally when engaged with a shaft 124.

Through-hole 144A is configured to have a geometry which is complementary to a corresponding shaft 124. In preferred embodiments, as depicted, through-hole 144A of the modular element 140A may have an obround geometry which is complementary to that of shaft 124. Specifically, through-hole 144A may have two parallel flat walls 145A and 145B and two opposing round walls 146A and 146B.

These walls are configured to be complementary to sides 125A, 125B, 126A, and 126B, respectively, of shaft 124.

Returning to FIGS. 1A-1C, two modular elements 140A and 140B are shown as being attachable to heel 120 in a vertical arrangement. In practice, any number of modular elements 140 may be configured for concurrent placement on the heel 120, depending on the length of the shaft 124. Modular elements 140 may be configured to be easily attached or detached from the heel 120 by sliding them along shaft 124 in a sequential manner. Preferably, the height of each modular element in a set of modular elements may be defined such that a desired number of modular elements may span a length of the shaft. In the depicted example, modular elements 140A and 140B may be designed to have a total height which is equal to the length from the top of shaft 124 to the top of locking member 128, such that the modular elements 140 rest snugly on the shaft 124 once the retention cap 150 is applied, as depicted in FIGS. 1B and 1C. Each modular element 140 may be configured to have sufficient minimum thickness about the through-hole 144 to ensure resistance against deformation or breakage during use. This thickness will vary depending on the material used, but may typically range from 0.5 to 2 times the maximum diameter of the shaft.

Modular elements 140 may have any desired exterior shape or form, such as alphanumeric characters, Greek letters, other textual characters, symbols, logos, crests, geometric shapes, or other figures. As a nonlimiting example, modular elements 140A and 140B have the form of the letters "D" and "R," respectively. Additional examples of modular elements are depicted in FIGS. 5A-5I. Modular elements may be formed of any suitable material, Modular elements 140 may be designed to represent individuals, Greek-letter organizations, civic groups, academic institutions, professional associations, cultural groups, and other organizations, allowing users to incorporate initials, acronyms, symbolic messages, or branding elements onto the heel.

The embodiments of FIGS. 1A-1C and 4A-4I depict through-holes which pass through substantially central portions of modular elements having alphanumeric designs such that the alphanumeric designs appear vertically aligned and in a right-side up orientation when engaged with the heel. In other embodiments, the through-holes may be configured to pass through any one or more portions of a modular element such that a desired alignment and/or orientation is achieved with respect to the heel rod. For example, in some embodiments, a set of modular elements may include one or more modular elements configured with a hole passing through a central portion, one or more modular elements configured with a hole passing through a left side portion, and one or more modular elements configured with a hole passing through a right side portion, such that combinations of modular elements may be aligned in a staggered or diagonal appearance with respect to the heel rod.

In some embodiments, one or more pairs of modular elements may be configured to be affixed to the heel rod in a horizontal arrangement. In such embodiments, a modular element may include one or more fastening members which is/are complementary to one or more fastening members of another modular element, where the complementary fastening members allow pairs of modular elements to be affixed to one another in a horizontal arrangement, in the desired orientation. Each modular element may further include one or more surface channels which is/are complementary to one or more surface channels of another modular element, whereby, when the modular elements are engaged with one another, the complementary channels form a through-hole which is used for engagement of the modular elements with the heel.

FIGS. 5-8 depict an example in which a modular heel system includes modular elements arranged in a horizontal arrangement. Referring to FIGS. 5A-5F, an axonometric view, a side view, a top view, a bottom view, a front view, and a rear view, respectively, of a first exemplary modular element 540 are shown. Referring to FIGS. 6A-6F, an axonometric view, a side view, a top view, a bottom view, a front view, and a rear view, respectively, of a second exemplary modular element 640 are shown. Modular elements 540 and 640 may have a body 542 and 642, respectively, which may have any desired form in accordance with the present disclosure. In order to engage with a second modular element in a horizontal manner, modular element 540 may include fastening projections 546A and 546B along the desired engagement surface of the body 542. The desired engagement surface further includes an engagement channel 544 which constitutes a first portion of a through-hole for engaging a shaft of a heel. That is, the walls of the engagement channel 544 may be designed to complement a first portion of a shaft. In the depicted embodiment, modular element 540 is designed to be engaged with an obround heel shaft and is therefore constructed with an engagement channel which has one flat side and two partial semicircular sides.

A second modular element, such as modular element 640, may include a complementary configuration for engaging with the first modular element 540. Modular element 640 may include fastening grooves 646A and 646B along its desired engagement surface which are configured to receive and retain the one or more fastening projections 546A and 546B, respectively. In the depicted example, projections 546A and 546B may be configured to slide into the grooves 646A and 646B and to lock in place at a desired position (e.g., through snap fit or friction fit). Modular element 640 may further include an engagement channel 644 along the desired engagement surface which constitutes a second portion of the through-hole for engaging the shaft of a heel. The engagement channels 544 and 644 may be configured to be complementary to one another such that, when mated, engagement channels 544 and 644 form a through-hole which is complementary to a corresponding heel shaft. In the depicted example, modular element 640 has a complementary engagement channel having one flat side and two partial semicircular sides.

FIGS. 7A-7D depict an axonometric view, a side view, a top view, and a bottom view, respectively, of the modular elements 540 and 640 after they have been engaged with one another. As depicted, modular elements 540 and 640 are engaged in a horizontal arrangement by means of projections 546A and 546B mating with grooves 646A and 646B, respectively. Once engaged, a through-hole 744 is formed by means of mating between engagement channels 544 and 644. Through-hole 744 preferably has a flat-sided geometry, and more preferably an obround shape, for engagement with a corresponding heel shaft.

Figure 8:
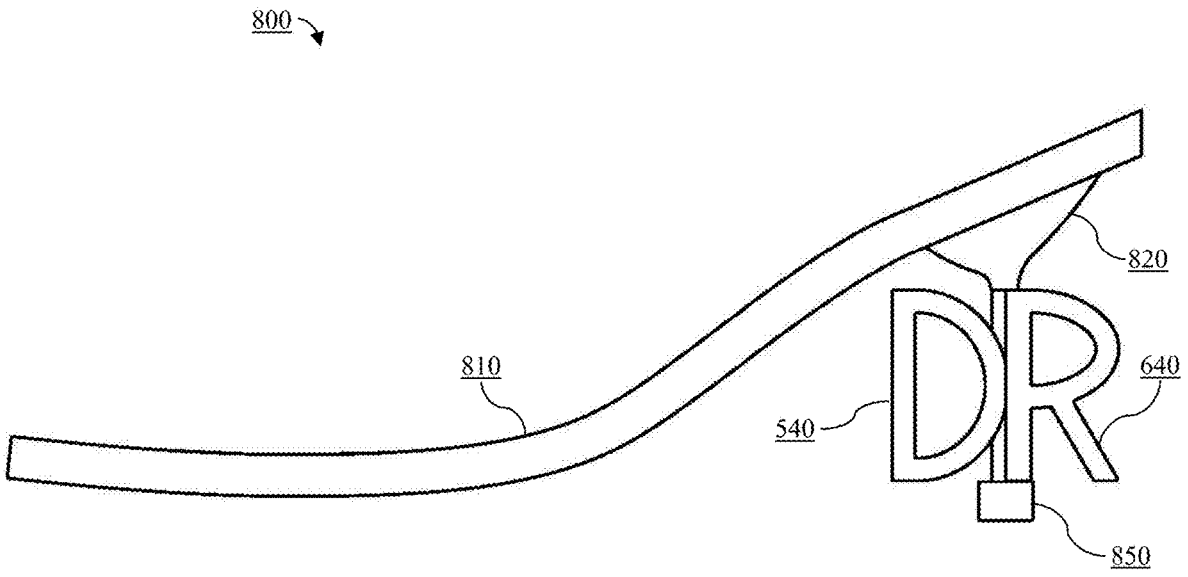

FIG. 8 depicts an exploded view and an assembled view, respectively, of a modular heel system including horizontally arranged modular elements. Modular heel system 800 may include sole 810, heel 820, and retention element 850, which may be described in substantially the same manner as elements 110, 120, and 150, respectively, of FIGS. 1A-1C. Modular heel system 800 further includes the modular elements 540 and 640. As described above, modular elements 540 and 640 are first engaged with one another to create a through-hole which is complementary to the shaft of heel 820. The shaft is then inserted through the through-hole created by elements 540 and 640 to engage the modular elements with the heel 820. Retention cap 850 is then affixed to a locking portion of heel 820 in order to secure the elements 540 and 640 on the heel.

In some embodiments, one or more modular elements may be configured as spacers which are designed to ensure proper alignment of irregularly shaped modular elements and/or to distribute compression forces between adjacent modular elements. Spacers may be constructed in a similar manner to other modular elements according to the present disclosure, but may differ in that they provide an expanded contact surface for interaction with adjacent elements. This may be critical when using irregular modular element designs whose bounding surfaces may not align at the shaft interface.

Figure 9A:
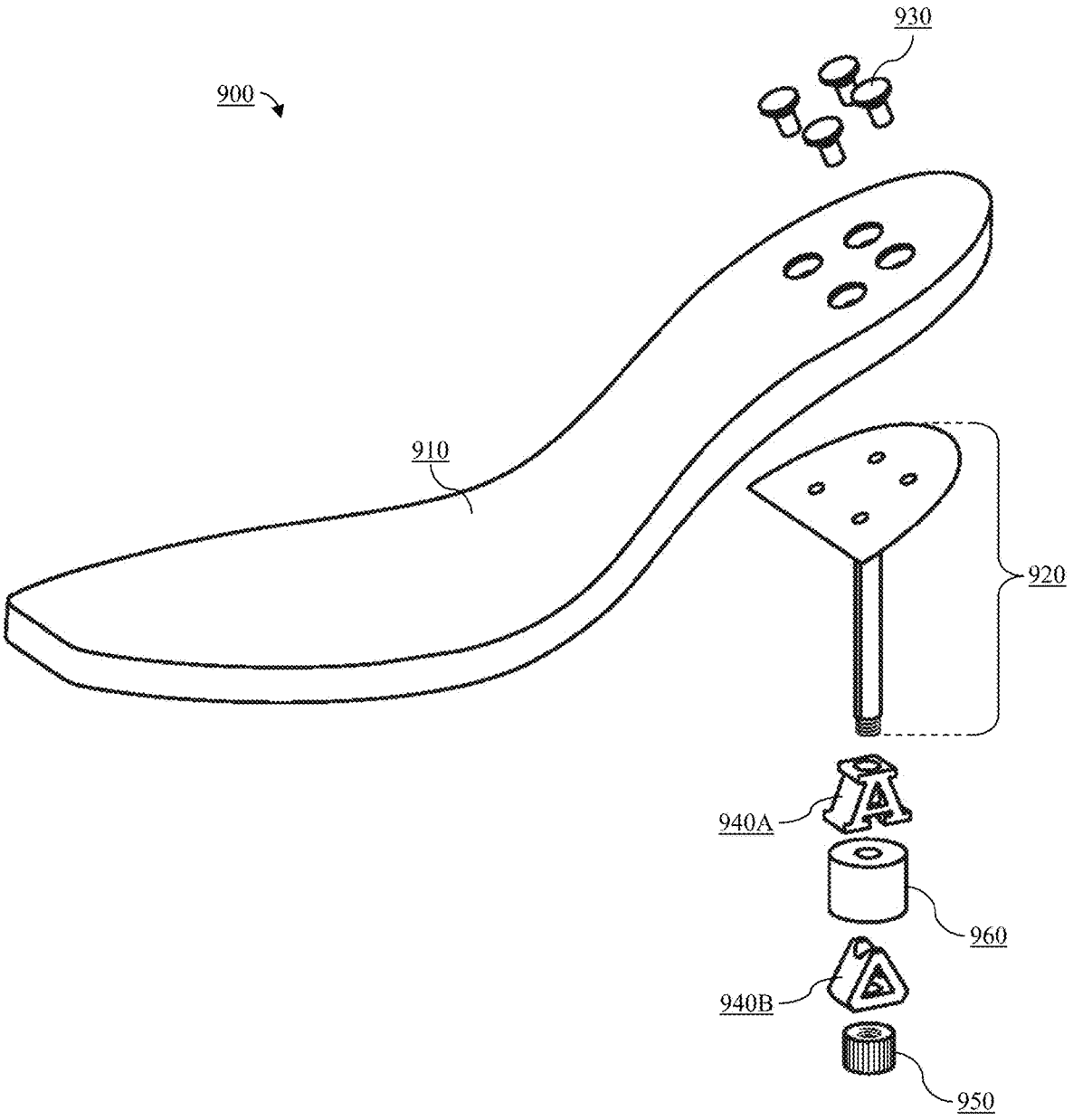
FIGS. 9A-9B depict an exemplary embodiment of a modular heel system incorporating a spacer element, in accordance with some embodiments.
Figure 9B:
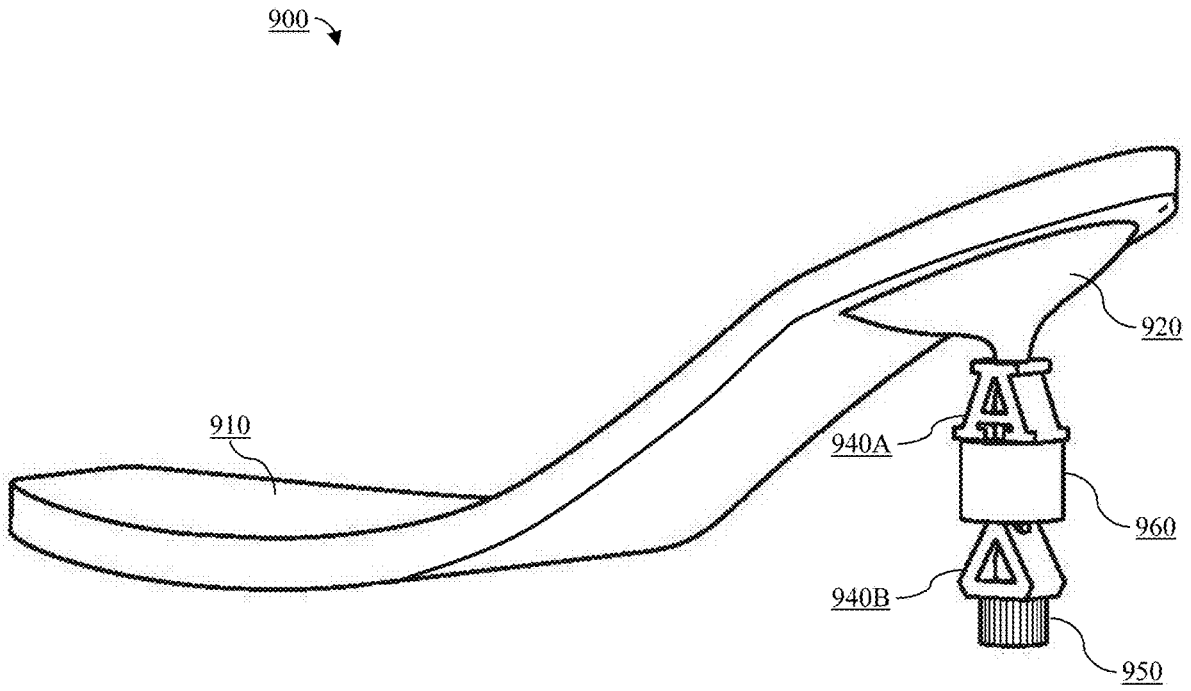
Figure 10A:
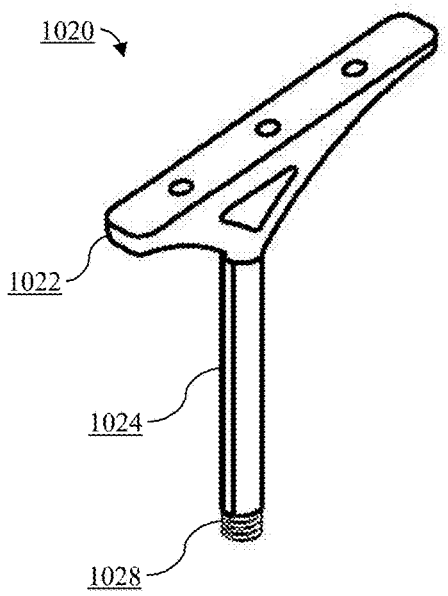
FIGS. 10A-10D depict an exemplary embodiment of a modified heel in accordance with the modular heel system of the present disclosure.
Figure 10B:
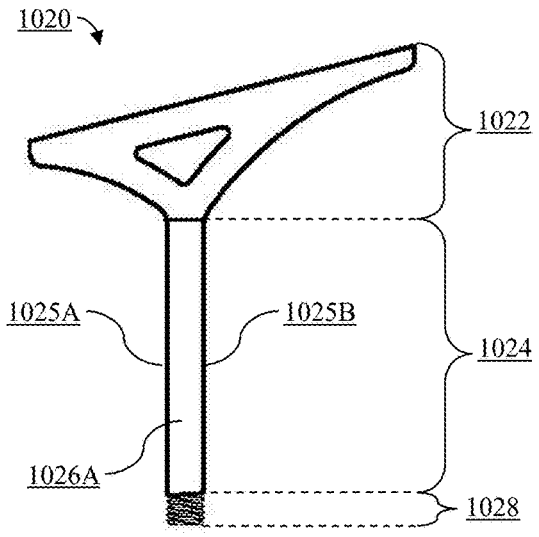
Figure 10C:
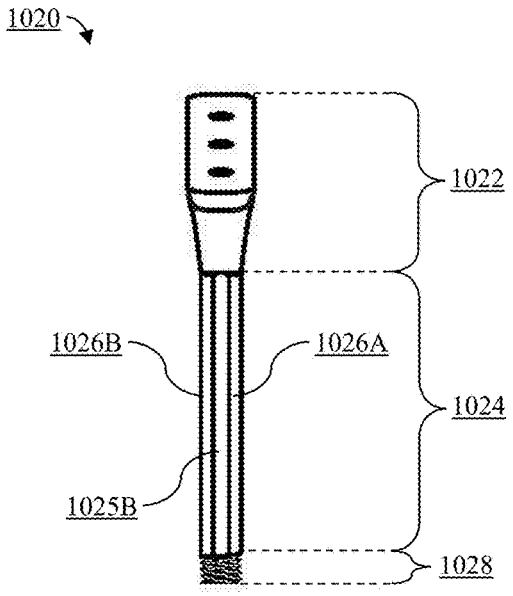
Figure 10D:
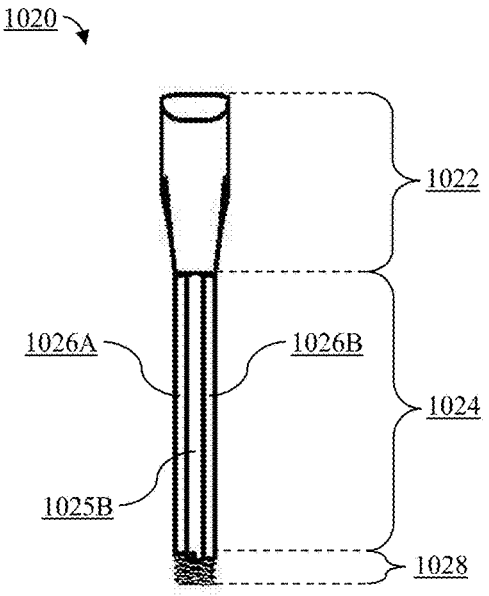

FIGS. 9A and 9B depict a modular heel system including a spacer element. Modular heel system 900 may include sole 910, heel 920, fasteners 930, modular elements 940, and retention element 950, which may be described in substantially the same manner as elements 110-150, respectively, of FIGS. 1A-1C. Modular heel system 900 further incorporates a spacer 960. In the depicted example, the lowermost surfaces of modular element 940A fail to align with the uppermost surface of modular element 940B at the shaft interface. In this case, slippage may occur during use, causing modular elements 940A and 940B to collapse onto one another. The spacer 960 is added here to provide expanded upper and lower surfaces for securing adjacent modular elements 940 in a fixed alignment. The upper and lower surfaces of spacer 960 may be perpendicular to the shaft of heel 920 and may be dimensioned such that they span a maximum width of a set of modular elements, such as a set of modular elements including modular elements 940A and 940B. When positioned between the two elements 940A and 940B, spacer 960 provides a solid contact zone for interfacing with the bounding surfaces of each of adjacent modular element, thus distributing compressive loads which may occur during walking and preventing axial displacement of the modular elements.

Returning to FIGS. 1A-1C, a locking member 128, which constitutes the lower end of shaft 124, is configured to engage with a retention element 150 for securing modular elements 140 on the shaft 124. As depicted, locking member 128 preferably includes threading which is complementary to a threaded cavity of a retention element 150 such that shaft 124 and retention element 150 may be seamlessly engaged and disengaged in a screw-like manner. This allows a user to easily secure retention element 150 onto shaft 124 when modular elements 140 are engaged and to easily remove the retention element 150 for removal or replacement of one or more modular elements 140, without the need for additional assembly tools.

Locking member 128 is configured to have a longitudinal diameter which is equal to or less than that of the upper portion of shaft 124 to enable engagement and disengagement of modular elements 140. Preferably, locking member 128 shares a longitudinal bounding perimeter with the upper portion of shaft 124 to ensure continuous load transfer through the length of the shaft. For example, in a shaft 124 having a maximum diameter of 6.0 mm, locking member 128 may be configured as a flat-sided M6 screw. The vertical length of locking member 128 may vary depending on material composition, load expectations, and overall configuration of the heel 120. Stronger materials such as metals may require shorter threads, whereas polymeric rods (e.g., ABS, polycarbonate) may require extended engagement zones to prevent pull-out or stripping. In some embodiments, the vertical length of locking member 128 may be approximately 0.75 to 3 times the diameter of shaft 124.

In alternate embodiments, locking member 128 may be configured as a cavity configured to receive a fastener. For example, locking member 128 may include a threaded cavity configured to receive a threaded bolt or screw which is incorporated into a retention element 150. The dimensions of the cavity may vary depending on material composition, load expectations, and overall configuration of the heel 120. As a nonlimiting example, locking member 128 may include a cavity with a nominal diameter of approximately 3.50 mm with a tolerance of ±0.05 mm. Other thread sizes, profiles (e.g., UNC, UNF, metric), and tolerances may be used to accommodate different performance criteria, including shear resistance, torque retention, and case of assembly. In some embodiments, locking member 128 may instead include an unthreaded cavity configured to engage a fastener through press-fit, snap-fit, or other type of mechanical engagement.

Retention element 150 is configured to be detachably affixed to heel 120 in order to enable users to secure and to disengage one or more modular elements 140. Retention element 150 is configured to be complementary to locking member 128. Retention element 150 is configured to mate with locking member 128 to form a secure engagement which is resistant to impact forces which occur during walking. In the depicted embodiment, retention element 150 includes a threaded cavity configured to receive and securely retain a threaded locking member 128. For example, retention element 150 may be configured as a threaded nut. The body and/or exterior surface of retention element 150 may be configured in any suitable shape, such as cubic, cylindrical, semicylindrical, or the like. Preferably, retention element 150 includes a flat bottom surface which is intended to be in contact with the ground during use. The dimensions of retention element 150 may be scaled based on the configuration of heel 120, materials used, and the expected vertical force distribution during use. The minimum vertical length of the cavity of retention element 150 typically corresponds to the full length of locking member 128, with larger lengths required for stability in nonmetal configurations. In alternate embodiments, retention cap 150 may be configured to include a projecting member (e.g., a threaded bolt or screw) configured to engage with a complementary cavity of the locking member 128. In other embodiments, snap-fit, press-fit, or other mechanical engagement mechanisms may be incorporated into the retention element 150 for engagement with a complementary configuration of the locking member 128.

Retention element 150 may be composed of one or more materials similar to those used for heel 120. Retention element 150 preferably includes a metal core which includes a cavity for receiving and securely retaining locking member 128 (or, alternatively, a projecting member for insertion into the locking member 128). In some embodiments, retention element 150 may be entirely composed of a metal material. In other embodiments, the body and/or exterior surface of retention element 150 may be composed of a secondary material, such as a polymer or rubber material, which houses a metal core and provides shock absorption and slip resistance when in contact with the ground. Alternatively, such a secondary material may be fitted onto an exterior surface of the retention element 150. For example, a rubber tab may be incorporated onto the bottom surface of the retention cap 150 for added stability while walking.

Heel 120 preferably has a singular construction. That is, heel body 122 and shaft 124 are preferably formed of a unitary piece of material, rather than separate components connected to one another. This may be accomplished through processes such as mold casting, CNC machining, or 3D printing. The unitary nature of heel 120 offers significant advantages in load-bearing strength and impact resistance compared to existing modular heel systems which have several heel components. Modular systems having multiple joints and connections between components create points of weakness where stress is concentrated, leading to potential failure under heavy loads. Additionally, existing modular components may become misaligned under the sudden or repeated impact which may occur while walking. The unitary structure of heel 120 mitigates such risks by providing a contiguous form which allows weight to be optimally distributed throughout the construction without deformation or breakage. Furthermore, the unitary structure results in a more comfortable walking experience for users compared to existing modular heel systems which have a rod or shaft attached to a heel base at a joint, which may cause undue stress at a single point on a user's heel.

Heel 120 is preferably formed of a metal material. In some embodiments, heel 120 may be formed of one or more of: steel, stainless steel, carbon steel, other steel alloy, copper, brass, bronze, other copper alloy, aluminum, aluminum alloy, titanium, titanium alloy, zinc, or zinc alloy. Metals have higher shear strength compared to other materials, which reduces the amount of load transferred from heel 120 to attached modular components 140 during use. Heel 120 may be manufactured through any suitable manufacturing process. Preferably, heel 120 is manufactured by mold casting, CNC machining, or 3D printing in order to ensure precision fits with other components of the heel rod system, such as modular elements 140 and retention cap 150.

In some embodiments, heel 120 may be formed using one or more polymers, such as glass fiber reinforced nylon, carbon fiber reinforced polymer, SLS nylon, polycarbonate, ABS plastic, or acetal. In some embodiments, a resin material may be implemented to form the heel 120, for example using a 3D printing process. While such materials are suitable for engaging modular elements 140, they may, in some cases, present strength and durability limitations under impact forces which occur during walking, when compared to embodiments including a metal heel. Benefits of using such materials are their affordability in mass manufacturing applications as well as their ability to be precisely machined in order to ensure compatibility with connecting parts.

In some embodiments, heel 120 may be formed using traditional heel materials such as wood or acrylics, although such materials may present several drawbacks during implementation. For instance, both wood and acrylic have limited tensile and shear strength compared to metals, which may cause the heel rod to deteriorate under the sudden and/or repeated impacts which occur during walking. Such weakness may especially be observed at attachment points where threaded or riveted configurations are implemented to mate the heel rod with retention cap 150 and/or fastener(s) 130. To account for this, in some embodiments, metal end fittings may be implemented at the upper and/or lower portions of the heel 120 in order to increase the strength of the heel rod at the attachment points. Additionally or alternatively, the heel 120 may be designed with a thicker cross-section in order to mitigate stress due to impact. Another drawback of materials such as wood and acrylic is that they may not provide an optimal surface for frictional, slidable engagement of modular elements 140. Wood is susceptible to deformation in response to environmental conditions such as heat and moisture, which may reduce the reliability of the friction fit connection between the heel 120 and modular elements 140. For instance, expansion of a wooden rod may reduce the user's ability to slide modular elements 140 onto and/or off of the heel 120 while shrinkage may result in a lack of sufficient surface interaction for securing modular elements 140 through frictional attachment. This variability may also reduce the reliability of other engagement types such as grooves or snap-fit connections. In the case of acrylics, the brittleness of the material may cause degradation of the heel 120 in response repeated engagement and disengagement of the modular elements 140 over time. To account for such drawbacks, in some embodiments, hardwoods such as oak, beech, or maple may be implemented, optionally with protective coatings such as varnish or epoxy to increase resistance to environmental impact. In some embodiments, acrylic materials may be subjected to chemical treatment, plasma treatment, annealing, or lamination in order to increase surface strength and resistance to cracking or buckling.

In some embodiments, heel 120 may be formed as a hybrid assembly including a unitary core formed of a first one or more materials and an exterior formed of a second one or more materials. For example, a metal core may be implemented as a primary structural support, while the exterior may be formed of a polymer or other material. In such embodiments, strength and durability of the heel may be preserved by means of the unitary core structure while a separate exterior material may be used to provide a desired look, feel, or fit. Such configurations may also provide design flexibility when considering material availability, manufacturing costs, and/or other production constraints.

In some embodiments, the modular heel system may include a heel body configured as a branched support structure. Referring to FIGS. 10A-10D, a heel 1020 may be configured with a modified heel body 1022 along with a shaft 1024. In the preferred embodiments, shaft 1024 may have an obround shape, with two flat parallel sides 1025A and 1025B and two opposing semicircular sides 1026A and 1026B, similar to shaft 124. In contrast to the construction of heel body 122, heel body 1022 has two branching segments extending laterally and upward from shaft 1024. An upper segment may span between the upper ends of the branching segments, creating a substantially flat upper surface for interfacing with a sole of a shoe. Heel body 1022 may include one or more cavities each configured to receive a corresponding fastener, such as fastener 130, for securing the heel 1020 to a sole, such as sole 110, where the sole 110 may be modified to incorporate fastener openings which are aligned with the cavities of heel body 1022. In some embodiments, the upper segment of heel body 1022 may be configured to be detachably engaged with a sole 110 through one or more detachable fastening mechanisms as discussed above with respect to heel body 122. Like heel body 122, the branched configuration of heel body 1022 provides enhanced load distribution compared to existing modular heel systems where load is focused along a single axis.

The modular heel system of the present disclosure enables a user to seamlessly customize and reconfigure their high-heeled shoes without the use of additional tools. The complementary configuration of the heel and the modular elements promotes proper alignment and allows the modular elements to be easily slid onto and off of the heel. When the modular elements are attached, the complementary flat-sided configuration of the shaft of the heel and the through-holes of the modular elements prevents rotational displacement, thus retaining the modular elements in a fixed orientation with respect to the heel. Once the modular elements are attached, the retention cap may be affixed to the locking portion of the heel in order to secure the modular elements vertically in place and to provide a contact surface between the heel system and the ground.

The foregoing disclosure provides illustration and description but is not intended to be exhaustive or to limit the implementations to the precise form disclosed. Modifications may be made in light of the above disclosure or may be acquired from practice of the implementations. Although particular combinations of features are recited in the claims and/or disclosed in the specification, these combinations are not intended to limit the disclosure of various implementations. In fact, many of these features may be combined in ways not specifically recited in the claims and/or disclosed in the specification.

It should be understood that the figures illustrate the exemplary embodiments in detail, and it should be understood that the present application is not limited to the details or the methodology presented in the description or illustrated in the figures. It is also to be understood that the terminology is for the purpose of description only and is not to be construed as limiting. Additional modifications and alternative embodiments of various aspects of the invention will be apparent to those of skill in the art in view of the present description. Consequently, this description will be considered to be illustrative only.

The construction and arrangements, shown in the various example embodiments, are illustrative only. Although only a few embodiments have been described in detail herein, many modifications (e.g., variations in sizes, dimensions, structures, shapes and proportions of the various elements, parameter values, mounting arrangements, use of materials, colors, orientations, etc.) are possible without materially departing from the teachings and novel advantages of the aspects described herein. Some elements shown as integrally formed may be constructed of multiple parts or elements, the position of elements may be reversed or otherwise varied, and the nature or number of discrete elements or positions may be altered or varied, unless explicitly stated otherwise or ruled out by context. The order or sequence of any process, logical algorithm, or method steps may be varied or re-sequenced according to alternative modalities. Other substitutions, modifications, changes, and omissions may also be made in the design, operating conditions, and arrangement of the various example embodiments without departing from the scope of the present invention.

Although the present application mentions particular combinations of features in the appended claims, various embodiments of the invention relate to any combination of the features described herein whether or not such combination is currently claimed, and any combination of features may be claimed, in this or future applications. Any of the features, elements, or components of any of the exemplary embodiments discussed above may be used individually or in combination with any of the features, elements, or components of any of the other embodiments discussed above.

In various example embodiments, relative dimensions, including angles, lengths, as shown in the figures are substantially to scale. Actual measurements of the figures will reveal relative dimensions, angles, and proportions of the various example embodiments. Several exemplary embodiments extend to various intervals around the dimensions, angles and proportions that can be determined from the figures and the associated descriptions. Various example embodiments include any combination of one or more relative dimensions or relative angles that can be determined from the figures and the associated descriptions. Actual dimensions not stated expressly in the present description may be determined using the measured dimensional relationships in the figures in combination with the explicit dimensions set forth in this description.

What is claimed is:

1. A modular heel system comprising:

a heel comprising:

a heel body configured to be attached to a sole of a shoe; and a shaft extending from the heel body, the shaft having at least one flat side along its longitudinal axis, wherein a lower portion of the shaft comprises a locking member;

one or more modular elements configured to be detachably positioned on the shaft, each modular element comprising a through-hole having a geometry which is complementary to a longitudinal geometry of the shaft; and a retention element comprising:

a core configured to mechanically mate with the locking member; and a body configured to retain the one or more modular elements on the shaft, the body further configured for interaction with a ground surface.

2. The modular heel system of claim 1, wherein the heel body and the shaft comprise a unitary structure.

3. The modular heel system of claim 1, wherein the heel comprises a metal material or a polymer material.

4. The modular heel system of claim 1, wherein the one or more modular elements comprise one or more materials selected from the group consisting of: polymer, metal, wood, resin, epoxy, fabric, leather, rubber, or a combination thereof.

5. The modular heel system of claim 1, wherein the heel consists of a metal material and the one or more modular elements consist of a polymer material.

6. The modular heel system of claim 1, wherein the shaft and each through-hole have similar or congruent form.

7. The modular heel system of claim 6, wherein the shaft and each through-hole have an obround geometry.

8. The modular heel system of claim 1, wherein the shaft and each through-hole have respective dimensions which ensure frictional retention of the modular elements when positioned on the shaft.

9. The modular heel system of claim 1, wherein at least one of the one or more modular elements comprises a body having an exterior form of an alphanumeric character, a symbol, a logo, a crest, or a geometric shape.

10. The modular heel system of claim 1, wherein the one or more modular elements comprise one or more pairs of modular elements configured to be affixed to the heel in a horizontal arrangement.

11. The modular heel system of claim 1, wherein the one or more modular elements comprise a pair of modular elements having one or more sets of complementary fastening members configured to secure the modular elements of said pair to one another in a horizontal arrangement.

12. The modular heel system of claim 1, wherein the one or more modular elements comprise a first modular element and a second modular element, wherein:

the first modular element has a first engagement channel;

the second modular element has a second engagement channel; and when the first modular element and the second modular element are secured to one another, the first engagement channel and the second engagement channel mate to form a through-hole through which the shaft may be inserted.

13. The modular heel system of claim 1, further comprising one or more spacer elements configured to provide an expanded contact surface for interfacing with one or more adjacent modular elements.

14. The modular heel system of claim 1, wherein at least one of the locking member and the core of the retention element comprises a threaded surface.

15. The modular heel system of claim 1, wherein a mating surface of the locking member is complementary to a mating surface of the core of the retention element.

16. The modular heel system of claim 1, wherein the core of the retention element comprises a cavity configured to receive at least a portion of the locking member.

17. The modular heel system of claim 1, wherein the core of the retention element comprises a projecting member configured to be inserted into at least a portion of the locking member.

18. The modular heel system of claim 1, wherein the one or more modular elements comprise at least two modular elements configured to be arranged in a vertical sequence on the shaft.

19. A modular heel system comprising:

a heel comprising:

a heel body configured to be attached to a sole of a shoe; and a shaft extending from the heel body, the shaft having at least one flat side along its longitudinal axis;

a pair of modular elements configured to be detachably positioned on the shaft, the pair of modular elements comprising:

a through-hole having a geometry which is complementary to a longitudinal geometry of the shaft; and one or more sets of complementary fastening members configured to secure the modular elements of said pair to one another in a horizontal arrangement; and a retention element configured to secure the pair of modular elements on the shaft.

20. A modular heel system comprising:

a heel comprising:

a heel body configured to be attached to a sole of a shoe; and a shaft extending from the heel body, the shaft having at least one flat side along its longitudinal axis;

a first modular element and a second modular element configured to be detachably positioned on the shaft, wherein:

the first modular element has a first engagement channel;

the second modular element has a second engagement channel; and when the first modular element and the second modular element are secured to one another, the first engagement channel and the second engagement channel mate to form a through-hole through which the shaft may be inserted, the through-hole having a geometry which is complementary to a longitudinal geometry of the shaft; and a retention element configured to secure the first modular element and the second modular element on the shaft.

* * * * *